US009117346B2

(12) United States Patent
Chen

(10) Patent No.: US 9,117,346 B2
(45) Date of Patent: Aug. 25, 2015

(54) GOODS CHANNEL FOR VENDING MACHINE

(71) Applicant: HON HAI PRECISION INDUSTRY CO., LTD., New Taipei (TW)

(72) Inventor: Yun-Lung Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 172 days.

(21) Appl. No.: 14/014,645

(22) Filed: Aug. 30, 2013

(65) Prior Publication Data

US 2014/0183207 A1 Jul. 3, 2014

(30) Foreign Application Priority Data

Dec. 27, 2012 (CN) ..... 2012 1 0577587

(51) Int. Cl.
*G07F 11/38* (2006.01)

(52) U.S. Cl.
CPC ..... *G07F 11/38* (2013.01)

(58) Field of Classification Search
CPC ..... G07F 11/005; G07F 11/38
USPC ..... 221/75, 123, 124, 130, 131, 133, 282, 221/283, 284, 285, 286, 151, 152, 154, 281
See application file for complete search history.

(56) References Cited

U.S. PATENT DOCUMENTS

| | | | | |
|---|---|---|---|---|
| 3,989,163 | A * | 11/1976 | Wittern | 221/75 |
| 4,023,704 | A * | 5/1977 | Pitel et al. | 221/75 |
| 6,302,293 | B1 * | 10/2001 | Wittern et al. | 221/92 |
| 7,128,379 | B1 * | 10/2006 | LaBonia et al. | 312/351 |
| 7,886,932 | B2 * | 2/2011 | Yanagisawa et al. | 221/197 |
| 8,100,292 | B2 * | 1/2012 | Kelly et al. | 221/241 |
| 8,469,729 | B2 * | 6/2013 | Ding | 439/131 |
| 8,602,226 | B1 * | 12/2013 | Chen et al. | 211/59.4 |
| 2014/0042879 | A1 * | 2/2014 | Chen et al. | 312/129 |
| 2014/0166691 | A1 * | 6/2014 | Chen et al. | 221/279 |
| 2014/0175119 | A1 * | 6/2014 | Chen et al. | 221/282 |

* cited by examiner

*Primary Examiner* — Patrick Mackey
(74) *Attorney, Agent, or Firm* — Novak Druce Connolly Bove + Quigg LLP

(57) ABSTRACT

A vending machine includes a goods rack, a restricting piece, and a positioning piece mounted on the goods rack. The goods rack defines a goods accommodating space and an opening. The restricting piece is pivotally mounted on the goods rack to cover the opening. The restricting piece includes a clasp. The positioning piece defines a first engaging hole and a second engaging hole. The restricting piece can rotate on the goods rack between a first securing position and a second securing position. In the first securing position, the clasp engages in the first engaging hole, so that the restricting piece is set at a first height. In the second securing position, the clasp engages in the second engaging hole, so that the restricting piece is set at a second height.

12 Claims, 5 Drawing Sheets

GOODS CHANNEL FOR VENDING MACHINE

BACKGROUND

1. Technical Field

The present disclosure generally relates to vending machines, and particularly to goods channels for a vending machine.

2. Description of Related Art

Vending machines have goods channels for accommodating goods of different heights for sale. Each goods channel accommodates goods of a certain height. However, when goods of a certain height are not sold, the corresponding goods channels are not used.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
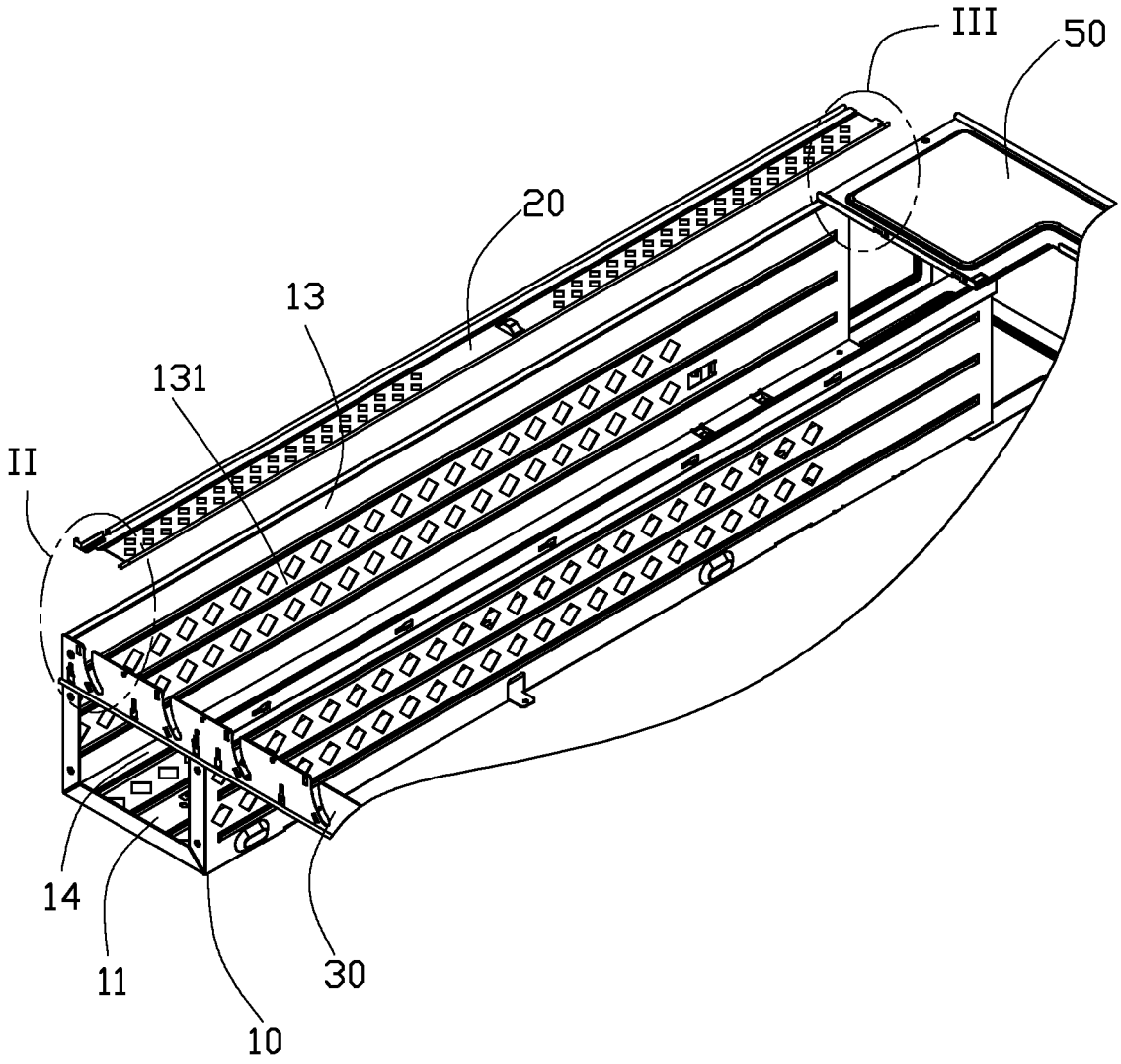
FIG. 1 is an exploded, isometric view of a vending machine with a heat transmission system, according to an exemplary embodiment.

FIG. 1 shows an embodiment of goods channels of a vending machine, including a goods rack 10 for receiving goods, and a plurality of restricting pieces 20.

Referring to FIG. 1, the goods rack 10 includes a bottom plate 11, and a plurality of parallel side plates 131 connected substantially perpendicularly to the bottom plate 11. A goods accommodating space 14 is cooperatively defined by two adjacent side plates 131 and the bottom plate 11. An opening 131 is defined between top edges of the two adjacent side plates 131. Goods are dispensed in the goods accommodating space 14 via the opening 131.

Figure 2:
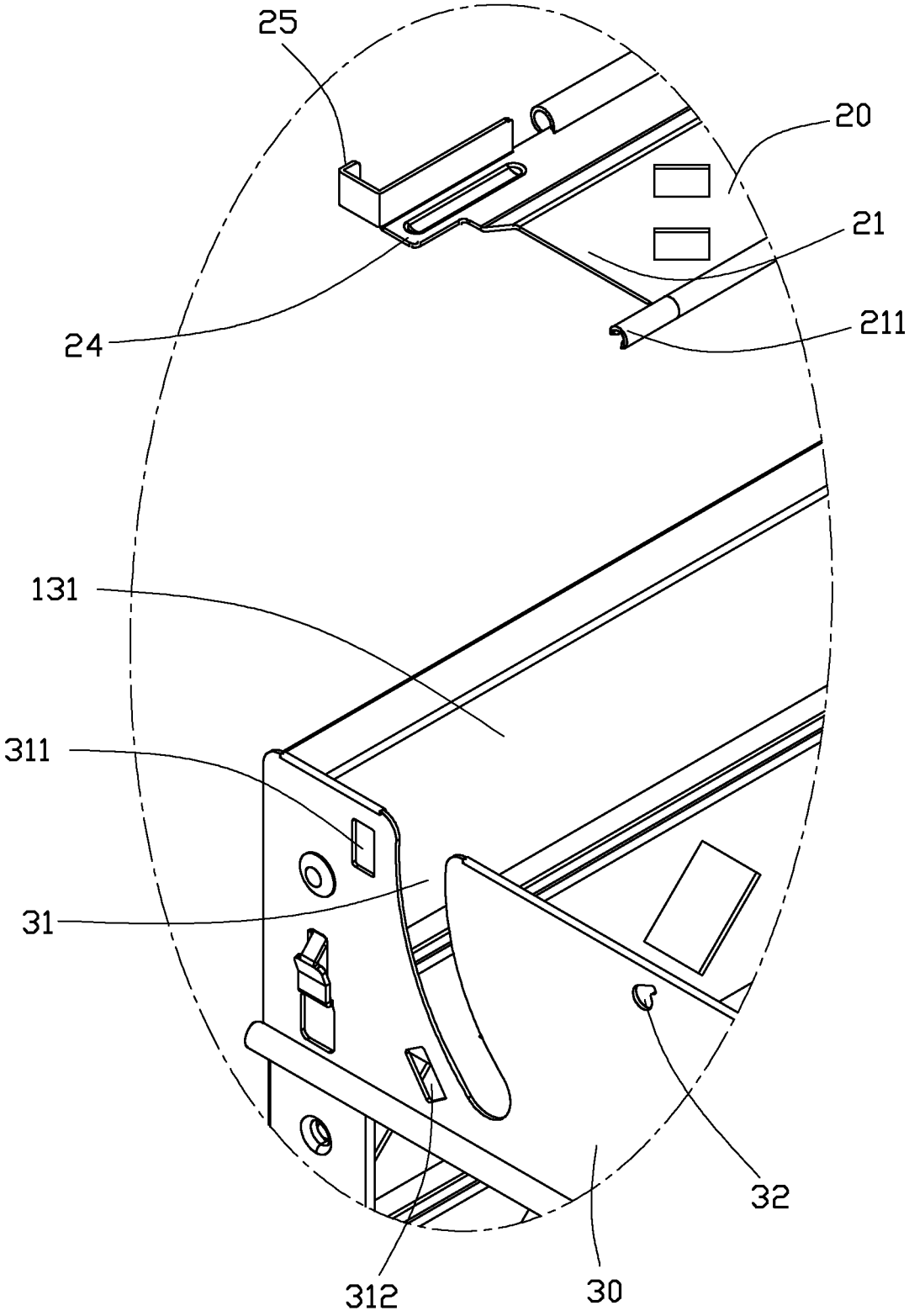
FIG. 2 is an enlarged view of a circled portion II of FIG. 1.
Figure 3:
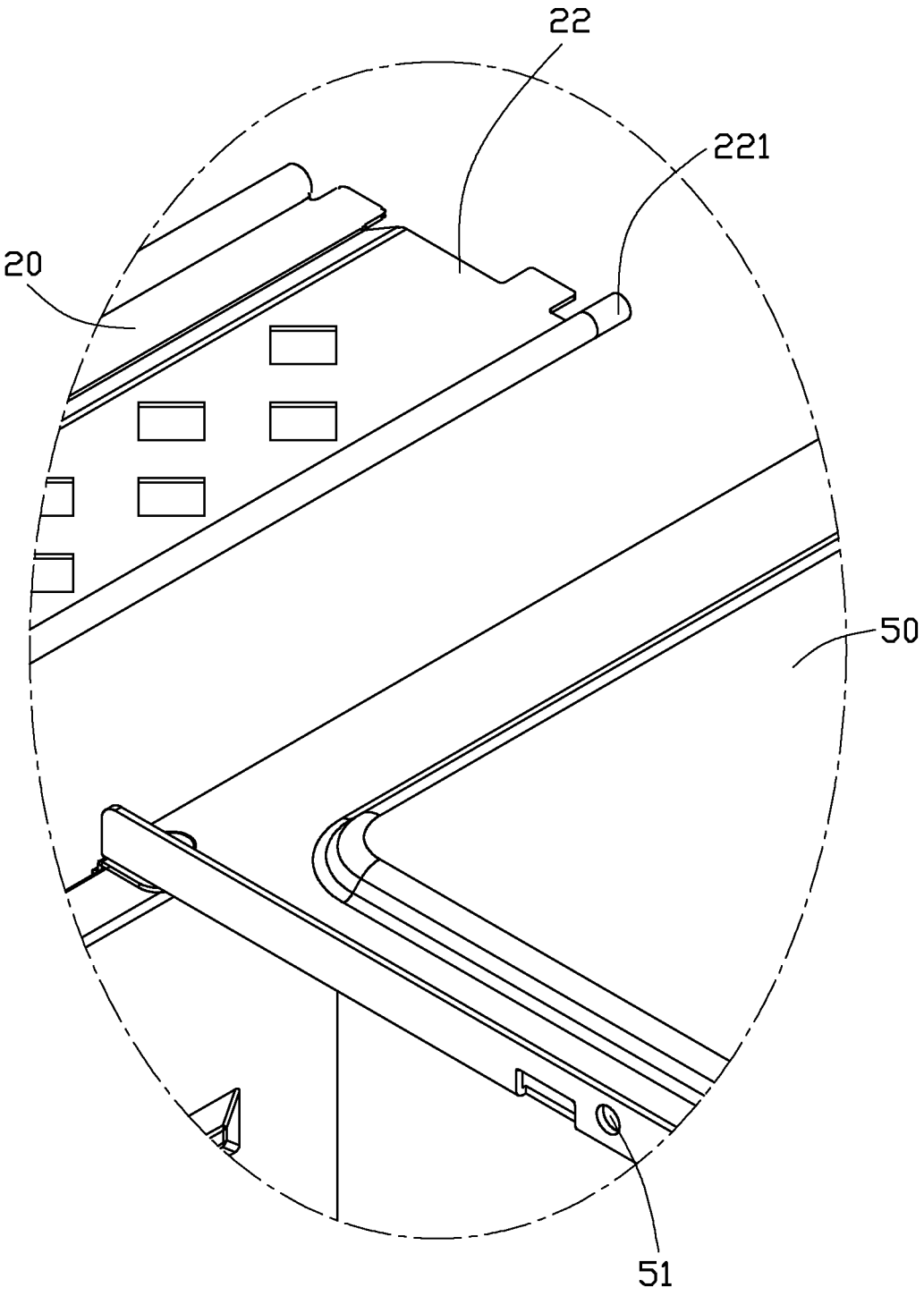
FIG. 3 is an enlarged view of a circled portion III of FIG. 1.
Figure 4:
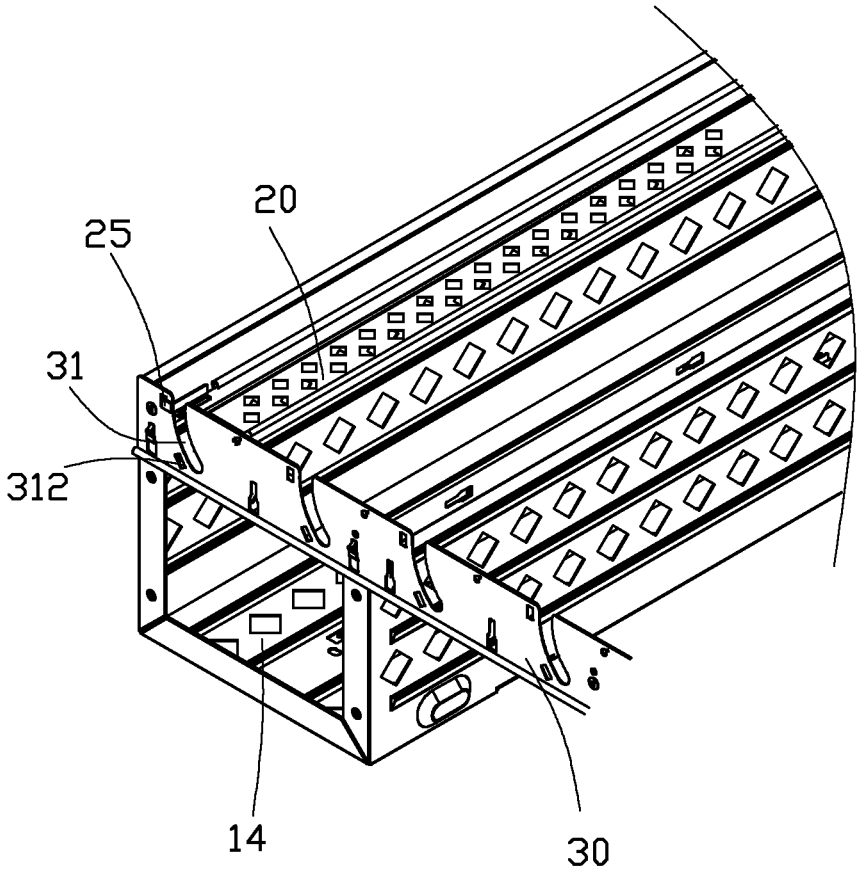
FIG. 4 is an assembled, isometric view of the vending machine of FIG. 1 in a state of use.
Figure 5:
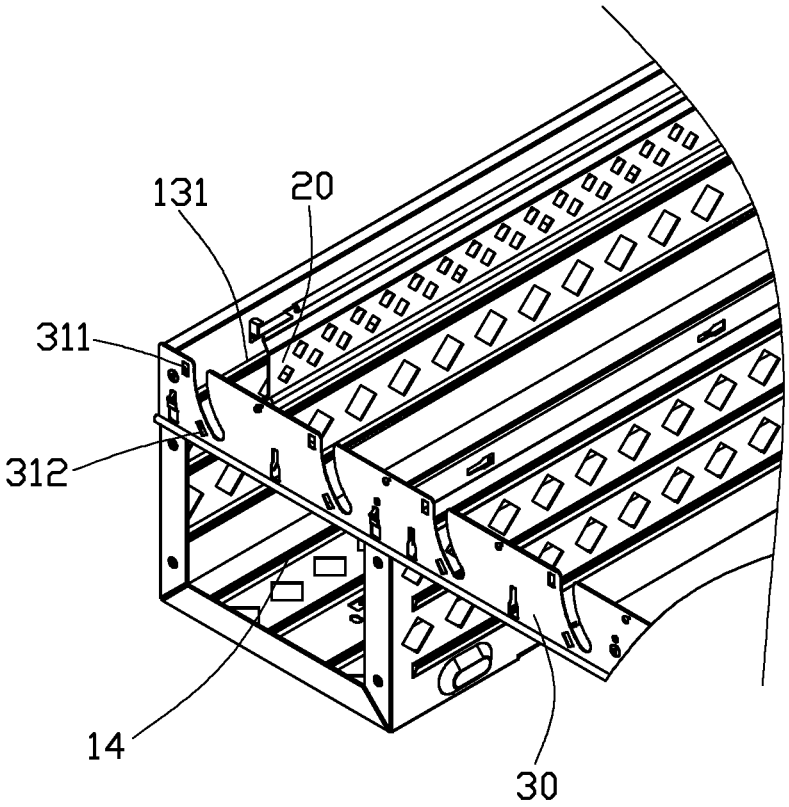
FIG. 5 is another assembled, isometric view of the vending machine of FIG. 1 in another state of use.

Referring to FIGS. 2 and 3, a positioning piece 30 is mounted on an end of the goods rack 10. A connection plate 50 is mounted on another end of the goods rack 10. The positioning piece 30 defines a sliding groove 31 corresponding to each goods accommodating space 14. The sliding groove 31 is arcuate. A first pivot hole 32 is defined in the positioning piece 30 at a radial center of an arcuate path of the sliding groove 31. The positioning piece 30 defines a first engaging hole 311 and a second engaging hole 312 adjacent the sliding groove 31. The first engaging hole 311 is located above the second engaging hole 312. The connection plate 50 defines a second pivot hole 51 corresponding to the first pivot hole 32.

The restricting piece 20 includes a first end 21 and a second end 22. The first end 21 is located adjacent to the positioning piece 30, and the second end 22 is located adjacent to the connection plate 50. The first end 21 includes a first pivot 211, and the second end 22 includes a second pivot 221. A guiding portion 24 is formed on the first end 21. The guiding portion 24 and the first pivot 211 are located on opposite edges of the first end 21. The guiding portion 24 includes a clasp 25.

Referring to FIGS. 1 to 5, in assembly, the first pivot 211 of the restricting piece 20 is pivotally inserted in the first pivot hole 32 of the positioning piece 30, and the second pivot 221 of the restricting piece 20 is pivotally inserted in the second pivot hole 51. Therefore, the restricting piece 20 is pivotally mounted on the goods rack 10.

The restricting piece 20 is configured to rotate on the goods rack 10. The restricting piece 20 rotates between a first securing position, a second securing position, and an open position. In the first securing position, the guiding portion 24 slides in the sliding groove 31, such that the clasp 25 engages in the first engaging hole 311. Therefore, the restricting piece 20 only allows tall goods to be held in the goods accommodating space 14.

In the second securing position, the guiding portion 24 slides to a bottom portion of the sliding groove 31, such that the clasp 25 engages in the second engaging hole 312. Therefore, the restricting piece 20 only allows short goods to be held in the goods accommodating space 14.

In the open position, the guiding portion 24 of the restricting piece 20 slides out of the sliding groove 31, such that the restricting piece 20 does not cover the opening 131. In the open position, new goods can be placed in the goods accommodating space 14 via the opening 131.

In the above goods rack 10, the restricting piece 20 is adjusted to hold goods of different heights in the goods accommodating space.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A vending machine, comprising:

a goods rack defining a goods accommodating space and an opening, the goods accommodating space being accessible via the opening;

a restricting piece pivotally mounted on the goods rack, the restricting piece being configured to cover the opening, the restricting piece comprising a clasp; and a positioning piece mounted on the goods rack, the positioning piece defining a first engaging hole and a second engaging hole;

wherein the restricting piece is configured to rotate on the goods rack between a first securing position and a second securing position; in the first securing position, the clasp is engaged in the first engaging hole, and the restricting piece is set at a first height; in the second securing position, the clasp is engaged in the second engaging hole, and the restricting piece is set at a second height.

2. The vending machine of claim 1, wherein the positioning piece defines a sliding groove, the restricting piece comprises a guiding portion, and the guiding portion is configured to slide in the sliding groove.

3. The vending machine of claim 2, wherein a first pivot hole is defined in the positioning piece at a radial center of an arcuate path of the sliding groove, the restricting piece comprises a first pivot, and the first pivot is inserted into the first pivot hole.

4. The vending machine of claim 3, wherein the goods rack comprise a connection plate, the connection plate defines a second pivot hole, and the restricting piece comprises a second pivot, and the second pivot is inserted into the second pivot hole.

5. The vending machine of claim 2, wherein the restricting piece is further adapted to rotate to an opening position at which the guiding portion slides out of the sliding groove.

6. The vending machine of claim 1, wherein the first engaging hole is located above the second engaging hole.

7. The vending machine of claim 6, wherein the first height is larger than the second height.

8. A vending machine, comprising:

a goods rack defining a goods accommodating space and an opening, the goods accommodating space being accessible via the opening;

a positioning piece defining a sliding groove and a first pivot hole, and the first pivot hole being located at a radial center of an arcuate path of the sliding groove; and a restricting piece mounted on the goods rack, the restricting piece comprising a first pivot and a guiding portion, the first pivot is inserted into the first pivot hole to pivotally mount the restricting piece on the goods rack, and the guiding portion is configured to slide in the sliding groove to cover the opening.

9. The vending machine of claim 8, wherein the goods rack comprise a connection plate, the connection plate defines a second pivot hole, and the restricting piece comprises a second pivot, and the second pivot is inserted into the second pivot hole.

10. The vending machine of claim 8, wherein the positioning piece defines a first engaging hole and a second engaging hole adjacent the sliding groove, the guiding portion comprises a clasp, the restricting piece is configured to rotate on the goods rack between a first securing position and a second securing position; at the first securing position, the clasp is engaged in the first engaging hole, and the restricting piece is set at a first height; at the second securing position, the clasp is engaged in the second engaging hole, and the restricting piece is set at a second height.

11. The vending machine of claim 10, wherein the first engaging hole is located above the second engaging hole.

12. The vending machine of claim 11, wherein the first height is larger than the second height.

* * * * *